US007485610B2

(12) United States Patent
Heinz et al.

(10) Patent No.: US 7,485,610 B2
(45) Date of Patent: Feb. 3, 2009

(54) METHOD FOR THE PRODUCTION OF A SOLID FRAGRANCE CONCENTRATE

(75) Inventors: Raymond Heinz, Leipzig (DE); Hans-Jürgen Huppert, Leipzig (DE); Katharina Girke, Leipzig (DE)

(73) Assignee: Bell Flavors & Fragrances Duft und Aroma GmbH, Miltitz (DE)

( * ) Notice: Subject to any disclaimer, the term of this patent is extended or adjusted under 35 U.S.C. 154(b) by 637 days.

(21) Appl. No.: 10/521,033

(22) PCT Filed: Oct. 8, 2003

(86) PCT No.: PCT/EP03/11109

§ 371 (c)(1), (2), (4) Date: Jan. 12, 2005

(87) PCT Pub. No.: WO2004/035721

PCT Pub. Date: Apr. 29, 2004

(65) Prior Publication Data

US 2005/0227905 A1 Oct. 13, 2005

(30) Foreign Application Priority Data

Oct. 11, 2002 (DE) ..... 102 47 583

(51) Int. Cl.
*C11D 3/50* (2006.01)
*C11D 13/12* (2006.01)
*C11D 1/68* (2006.01)

(52) U.S. Cl. ..... 510/141; 510/101; 510/182; 510/224; 510/253; 510/294; 510/342; 510/353; 510/356; 510/358; 510/399; 510/437; 510/440; 510/446

(58) Field of Classification Search ..... 510/101, 510/141, 182, 224, 253, 294, 342, 353, 356, 510/358, 399, 437, 440, 446
See application file for complete search history.

(56) References Cited

U.S. PATENT DOCUMENTS

| | | | | |
|---|---|---|---|---|
| 2,300,769 | A | 11/1942 | Berry | |
| 3,945,950 | A | 3/1976 | Vosganiantz | |
| 4,017,574 | A * | 4/1977 | Joshi | 510/146 |
| 4,152,272 | A * | 5/1979 | Young | 510/101 |
| 4,617,147 | A | 10/1986 | Shibanai | |
| 4,636,330 | A | 1/1987 | Melville | |
| 4,741,899 | A * | 5/1988 | Henry et al. | 424/47 |
| 5,002,681 | A * | 3/1991 | Wierenga et al. | 510/297 |
| 5,154,842 | A * | 10/1992 | Walley et al. | 510/523 |
| 5,194,172 | A * | 3/1993 | Taneri et al. | 510/145 |
| 5,378,468 | A * | 1/1995 | Suffis et al. | 424/401 |
| 5,635,164 | A * | 6/1997 | Moghe et al. | 424/65 |
| 5,916,546 | A * | 6/1999 | Sawin et al. | 424/65 |
| 6,531,444 | B1 * | 3/2003 | Shefer et al. | 510/519 |
| 6,569,438 | B1 * | 5/2003 | Banowski et al. | 424/401 |
| 2003/0126788 | A1 * | 7/2003 | Uang et al. | 44/275 |
| 2003/0195130 | A1 * | 10/2003 | Lentsch et al. | 510/327 |

FOREIGN PATENT DOCUMENTS

| | | | |
|---|---|---|---|
| DE | 197 35 783 | A | 2/1999 |
| DE | 19735783 | | 2/1999 |
| DE | 198 08 757 | A1 | 9/1999 |
| DE | 199 17 692 | A1 | 10/2000 |
| DE | 199 48 667 | A1 | 4/2001 |
| DE | 100 63 428 | S1 | 7/2002 |
| EP | 0 036 720 | | 8/1983 |
| EP | 0 397 246 | A3 | 11/1990 |
| EP | 0 469 228 | B1 | 2/1992 |
| EP | 0 679 715 | B1 | 11/1995 |
| EP | 469228 | * | 5/1996 |
| EP | 0 864 637 | B1 | 9/1998 |
| EP | 0 908 188 | A | 4/1999 |
| EP | 0 909 807 | B1 | 4/1999 |
| EP | 0908188 | | 4/1999 |
| FR | 2123824 | | 9/1972 |
| FR | 2123824 | A | 9/1972 |
| WO | WO 99/09136 | | 2/1999 |
| WO | WO 99/21953 | | 5/1999 |
| WO | WO 02 38713 | A1 | 5/2002 |

OTHER PUBLICATIONS

International Search Report.

* cited by examiner

*Primary Examiner*—Charles I Boyer
(74) *Attorney, Agent, or Firm*—Collard & Roe, P.C.

(57) ABSTRACT

The invention relates to a method for the production of a solid fragrance concentrate, by absorption of a liquid fragrance or fragrance mixture in a solid or solid mixture, using one or several surfactants and/or co-surfactants, solid at normal temperatures as solid or solid mixture, whereby the liquid fragrance or fragrance mixture is dissolved in the above at a temperature above the solidification temperature of the solid or solid mixture and the solution subsequently solidified by cooling. The solid or solid mixture comprises fatty alcohol(s) or a mixture of fatty alcohol(s) and fatty acid(s) and/or fatty alcohol ethoxylate and/or polyethylene glycol.

7 Claims, No Drawings

METHOD FOR THE PRODUCTION OF A SOLID FRAGRANCE CONCENTRATE

CROSS REFERENCE TO RELATED APPLICATIONS

Applicants claim priority under 35 U.S.C. §119 of German Application No. 102 47 583.0 filed Oct. 11, 2002. Applicants also claim priority under 35 U.S.C. §365 of PCT/EP2003/011109 filed Oct. 8, 2003. The international application under PCT article 21(2) was not published in English.

The invention relates to a method for the production of a solid fragrance concentrate, which can advantageously be used for perfuming solid soaps, solid detergents and fabric softeners, in powder, granulate, chip or tablet form, and of other solid household chemical products or cosmetic products.

A large number of fragrances or fragrance mixtures are substances that are liquid and often highly volatile at room temperature, and introducing them into solid household chemical products or cosmetic products, such as solid soaps or detergents and fabric softeners in powder, granulate, chip or tablet form, causes problems.

The known technologies for perfuming solid soaps are based, for example, on intensive mixing of the refined crude soap with liquid fragrance concentrate before extrusion and cutting as well as subsequent pressing to form individual pieces of soap. If the liquid fragrances are introduced into the refined crude soap in larger amounts, the consistency of the soap is influenced negatively.

It is also disadvantageous that the fragrances introduced into the solid soaps in this manner evaporate relatively quickly, because the basic soap substance can actually bind the fragrances only in very small amounts, so that after extended storage, most of the solid soaps produced in this manner have lost a major portion of their pleasant scent.

According to the state of the art, powdered solid detergents and fabric softeners are intensively mixed with micro-sprayed liquid fragrance concentrate before they are packaged, i.e. before they are shaped into tablets, chips, etc. When the fragrances are sprayed, high losses of substance already occur in production, due to evaporation. In addition, the fragrances, which are often highly volatile and flammable, can form explosive gas/air mixtures with air, and as a result, small explosions and fires can occur in the production facilities.

In order to avoid these disadvantages, attempts were already made to produce solid fragrance concentrates, in that powdered precipitated silicic acid, for example, or other powdered carrier materials that have a large internal surface were wetted with the liquid fragrances or fragrance mixtures, thereby causing the liquid fragrance or the liquid fragrance mixture to be adsorbed by the powdered materials and bound to the internal surface of these materials. It is true that these powdered carrier materials are able to absorb and bind relatively large proportions of liquid fragrances, but since they are not well soluble in water, they represent undesirable inert ingredients, particularly for detergents and fabric softeners, which result in harmful deposits on the goods being washed or softened, as well as in the equipment and lines, and they are therefore unsuitable as carrier materials for the introduction of fragrances, particularly into solid soaps as well as solid detergents and fabric softeners. In addition, the adhesion capacity of these known substances is so great, in some cases, because of their large internal surface, that the fragrances cannot be released and develop their effect during the washing or rinsing process, and therefore are rinsed away without having been used.

Furthermore, a high-dosage fragrance solid having a content of 20 to 50 wt.-% fragrance and a remaining amount, i.e. at least 50% carrier material consisting of fatty acid and fatty acid salt is known from DE 19735783 A1. Of this proportion of the carrier material of at least 50 wt.-% of the total mass of the fragrance solid, up to 50 wt.-% can be replaced with usual ingredients of detergents and cleaners, such as enzymes, bleaches, foam inhibitors, dyes, pH adjustment agents, etc., whereby these ingredients possess carrier material properties only in part.

The fragrance solids last mentioned are limited to a fragrance absorption of 50 wt.-%. In addition, the fatty acids and fatty acid salts used as carrier materials are biodegradable only to a limited degree.

It is therefore the task of the invention to develop a method for the production of a solid fragrance concentrate by means of absorption of a liquid fragrance in a solid or a solid mixture, in which the solid or the solid mixture is able to absorb the liquid fragrance or the liquid fragrances also in amounts more than 50 wt.-% fragrance part, without binding it/them to an overly great extent, and without the solid or the solid mixture representing an insoluble inert substance. In addition, the solid or the solid mixture should be biologically better degradable.

This task is accomplished by means of the characterizing features of claim 1. Advantageous embodiments of the invention are formed by the characteristics of dependent claims 1 to 7.

The invention will be explained in greater detail below, using preferred exemplary embodiments.

Most fragrances are in the liquid aggregate state at a normal temperature of 20° C. Fragrances that are ready for use by the consumer are, in most cases, fragrance mixtures consisting of up to 40, in individual cases even more individual fragrance components. In order to be able to introduce these liquid fragrances or fragrance mixtures, which are liquid at normal temperature, into solid soaps, into powders or into detergents and fabric softeners present in solid form, or into other solid household chemical products or cosmetic products, in relatively high concentrations and in a convenient manner, without noticeably impairing the quality of the products or causing disadvantages or risks in the production process, the liquid fragrances are dissolved in surfactants or co-surfactants that are solid at normal temperature and comprise fatty alcohol(s) or a mixture of fatty alcohol(s) with fatty acid(s) and/or fatty alcohol ethoxylate and/or polyethylene glycol, according to the invention. This is done by heating the fatty alcohol or fatty alcohols or the stated substance mixtures to temperatures that are only slightly above the solidification point of these carrier substances, followed by introduction of the liquid fragrances or fragrance mixtures into the liquefied carrier substances and subsequent cooling, whereby the carrier substances solidify with the at least one fragrance dissolved in them, below a certain solidification temperature that lies above the normal temperature of 20° C., to form a solid fragrance concentrate according to the invention.

By means of the method according to the invention, it is possible to dissolve up to 60 wt.-% liquid fragrances in the afore-named carrier materials.

In a special case of use, 40 wt.-% of a liquid fragrance mixture were dissolved in 60 wt.-% of a liquefied fatty alcohol C22 that was heated to a temperature of a few degrees above the solidification point of 70° C. The fatty alcohol/fragrance solution solidified when cooled to a temperature below 54° C., to form the solid fragrance concentrate according to the invention.

In another case of use, 40 wt.-% of a liquid fragrance mixture were dissolved in a liquefied mixture of 30 wt.-% fatty alcohol C22 and 30 wt.-% fatty acid (stearin), which had a solidification point of 68° C. The fatty alcohol/fatty acid/fragrance solution solidified when cooled to a temperature below 47° C., to form the solid fragrance concentrate according to the invention.

In yet another case of use, 40 wt.-% fragrances were dissolved in a liquefied mixture of 30 wt.-% fatty alcohol C22 and 30 wt.-% polyethylene glycol, which had a solidification point of 60° C., at a temperature of 80° C. The fatty alcohol/polyethylene glycol/fragrance solution solidified when cooled to a temperature below 54° C., to form the solid fragrance concentrate according to the invention.

It was possible to produce the solid fragrance concentrates obtained in the above manner by means of known methods, in tablet or granulate form, and in this form, they can be easily added and precisely metered in the production of solid soaps, detergents and fabric softeners in powder, granulate, or tablet form, or other solid household chemical products or cosmetic products.

The exemplary embodiments described merely serve to explain the invention. The scope of protection of the invention is determined by the wording of the attached claims.

The invention claimed is:

1. A method for the production of a solid fragrance concentrate comprising the steps of:

a) absorbing a liquid fragrance or fragrance mixture in a solid mixture, said solid mixture comprising a C22 fatty alcohol, and one or more surfactants and/or co-surfactants that are solid at 20° C.; wherein the absorption is achieved by dissolving from 10 to 60% by weight of the concentrate of the liquid fragrance or the fragrance mixture in from 40 to 90% by weight of the concentrate of the C22 fatty alcohol at a temperature that lies between 66 and 70° C.; and b) then solidifying the concentrate by means of cooling the solution to a temperature below 54° C.

2. A method for the production of a solid fragrance concentrate comprising the steps of:

a) absorbing a liquid fragrance or fragrance mixture in a solid mixture, said solid mixture comprising a C22 fatty alcohol, a fatty acid, and one or more surfactants and/or co-surfactants that are solid at 20° C.; wherein the absorption is achieved by dissolving from 10 to 60% by weight of the concentrate of the liquid fragrance or fragrance mixture in a mixture of from 20 to 45% by weight of the concentrate of the C22 fatty alcohol and from 20 to 45% by weight of the concentrate of the fatty acid at a temperature that lies above the solid mixture's solidification temperature; and b) then solidifying the concentrate by means of cooling the solution to a temperature below 47°.

3. A method for the production of a solid fragrance concentrate comprising the steps of:

a) absorbing a liquid fragrance or fragrance mixture in a solid mixture, said solid mixture comprising a C22 fatty alcohol, a fatty alcohol ethoxylate, and one or more additional surfactants and/or co-surfactants that are solid at 20° C.; wherein the absorption is achieved by dissolving from 10 to 60% by weight of the concentrate of the liquid fragrance or fragrance mixture in a mixture of from 20 to 45% by weight of the concentrate of the C22 fatty alcohol and from 20 to 45% by weight of the concentrate of the fatty alcohol ethoxylate at a temperature that lies between 55 and 60°; and b) then solidifying the concentrate by means of cooling the solution to a temperature below 47° C.

4. A method for the production of a solid fragrance concentrate comprising the steps of:

a) absorbing a liquid fragrance or fragrance mixture in a solid mixture, said solid mixture comprising a C22 fatty alcohol, polyethylene glycol, and one or more additional surfactants and/or co-surfactants that are solid at 20° C.; wherein the absorption is achieved by dissolving from 10 to 60% by weight of the concentrate of the liquid fragrance or fragrance mixture in a mixture of from 20 to 45% by weight of the concentrate of the C22 fatty alcohol and from 20 to 45% by weight of the concentrate of polyethylene glycol at a temperature that lies between 55 and 60°; and b) then solidifying the concentrate by means of cooling the solution to a temperature below 54° C.

5. Method as recited in claim 1, wherein the fragrance concentrate is solidified in a shaping process.

6. Method as recited in claim 5, wherein the fragrance concentrate is formed into tablets.

7. Method as recited in claim 5, wherein the fragrance concentrate is granulated.

* * * * *